US010768548B2

(12) United States Patent
Noda et al.

(10) Patent No.: US 10,768,548 B2
(45) Date of Patent: Sep. 8, 2020

(54) IMAGE FORMING APPARATUS

(71) Applicant: BROTHER KOGYO KABUSHIKI KAISHA, Nagoya-shi, Aichi-ken (JP)

(72) Inventors: Ryuji Noda, Nagoya (JP); Koyo Yamamoto, Nisshin (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 16/727,750

(22) Filed: Dec. 26, 2019

(65) Prior Publication Data

US 2020/0209781 A1 Jul. 2, 2020

(30) Foreign Application Priority Data

Dec. 28, 2018 (JP) ..... 2018-246386
Aug. 5, 2019 (JP) ..... 2019-143891

(51) Int. Cl.

*G03G 15/16* (2006.01)
*G03G 15/08* (2006.01)
*G03G 21/00* (2006.01)
*G03G 15/01* (2006.01)

(52) U.S. Cl.

CPC ..... *G03G 15/0808* (2013.01); *G03G 15/0194* (2013.01); *G03G 21/0058* (2013.01); *G03G 2215/0141* (2013.01); *G03G 2221/1684* (2013.01)

(58) Field of Classification Search

CPC ..... G03G 15/0178; G03G 15/0194; G03G 15/0808; G03G 15/16; G03G 21/0058; G03G 21/1633; G03G 21/1839; G03G 21/1842; G03G 21/1853; G03G 21/1871; G03G 2221/1654; G03G 2221/1869

USPC ..... 399/107, 110, 111, 116, 117, 297–301

See application file for complete search history.

(56) References Cited

U.S. PATENT DOCUMENTS 7,792,464 B2 * 9/2010 Okabe ..... G03G 15/0813 399/228
8,452,208 B2 * 5/2013 Kikuchi ..... G03G 21/16 399/113
9,069,329 B2 * 6/2015 Murakami ..... G03G 21/1661
9,086,675 B2 * 7/2015 Okabe ..... G03G 21/1633
9,244,427 B2 * 1/2016 Sato ..... G03G 21/1623

(Continued)

FOREIGN PATENT DOCUMENTS

JP 2013-076877 A 4/2013

*Primary Examiner* — Hoan H Tran
(74) *Attorney, Agent, or Firm* — Baker Botts L.L.P.

(57) ABSTRACT

An image forming apparatus includes a housing, a drawer, a photosensitive member rotatably supported by the drawer, a first roller rotatably supported by the drawer, a second roller, an urging member disposed at the housing for urging the second roller toward the first roller, and a positioner. The drawer is movable between a housed position at which the drawer is housed in the housing, and a shifted position at which the drawer is shifted from the housed position toward an exterior of the housing. The second roller is rotatably supported by the housing, disposed to face the first roller, and movable relative to the first roller. The second roller and the first roller pinch a sheet therebetween and transport the sheet toward the photosensitive member. The positioner is disposed at the drawer and positions the second roller relative to the first roller when the drawer is at the housed position.

13 Claims, 11 Drawing Sheets

(56) References Cited

U.S. PATENT DOCUMENTS

| | | | | |
|---|---|---|---|---|
| 10,509,360 | B2 * | 12/2019 | Hijikata | G03G 21/1817 |
| 2013/0084096 | A1 | 4/2013 | Hashimoto | |

* cited by examiner

IMAGE FORMING APPARATUS

CROSS-REFERENCE TO RELATED APPLICATION

This application claims priority from Japanese Patent Application Nos. 2018-246386 filed on Dec. 28, 2018, and 2019-143891 filed on Aug. 5, 2019, the content of which is incorporated herein by reference in its entirety.

TECHNICAL FIELD

Aspects of the disclosure relates to an image forming apparatus.

BACKGROUND

A known image forming apparatus includes an image forming unit, a pinch roller for transporting a sheet from a sheet tray to the image forming unit, and a paper powder removal roller facing the pinch roller.

The known image forming apparatus further includes a drawer supporting a plurality of photosensitive drums. The drawer is movable between an inside position at which the drawer is housed in a housing, and an outside position at which the drawer is shifted from the inside position toward an exterior of the housing.

The pinch roller is rotatably supported by the housing. The paper powder removal roller is rotatably supported by the drawer and moves as the drawer moves. When the drawer moves from the outside position to the inside position, the paper powder removal roller, which is urged by a coil spring toward the pinch roller, moves toward and is positioned relative to the pinch roller.

SUMMARY

In the known image forming apparatus, due to dimensional or assembly errors of components, the paper powder removal roller may be positioned skewly relative to the pinch roller. This may cause skew of a sheet transported relative to the photosensitive drums and skew of an image formed relative to the sheet, resulting in hindrance to image forming with an improved accuracy.

Aspects of the disclosure provide an image forming apparatus configured to form an image with an improved accuracy.

According to one or more aspects of the disclosure, an image forming apparatus includes a housing, a drawer, a photosensitive member rotatably supported by the drawer, a first roller rotatably supported by the drawer, a second roller, an urging member urging the second roller toward the first roller, and a positioner. The drawer is movable between a housed position at which the drawer is housed in the housing, and a shifted position at which the drawer is shifted from the housed position toward an exterior of the housing. The second roller is rotatably supported by the housing, disposed to face the first roller, and movable relative to the first roller. The second roller and the first roller are configured to pinch a sheet therebetween and transport the sheet toward the photosensitive member. The positioner is disposed at the drawer and configured to position the second roller relative to the first roller when the drawer is at the housed position.

DETAILED DESCRIPTION

Illustrative embodiments of the disclosure will now be described with reference to the drawings.

Figure 1:
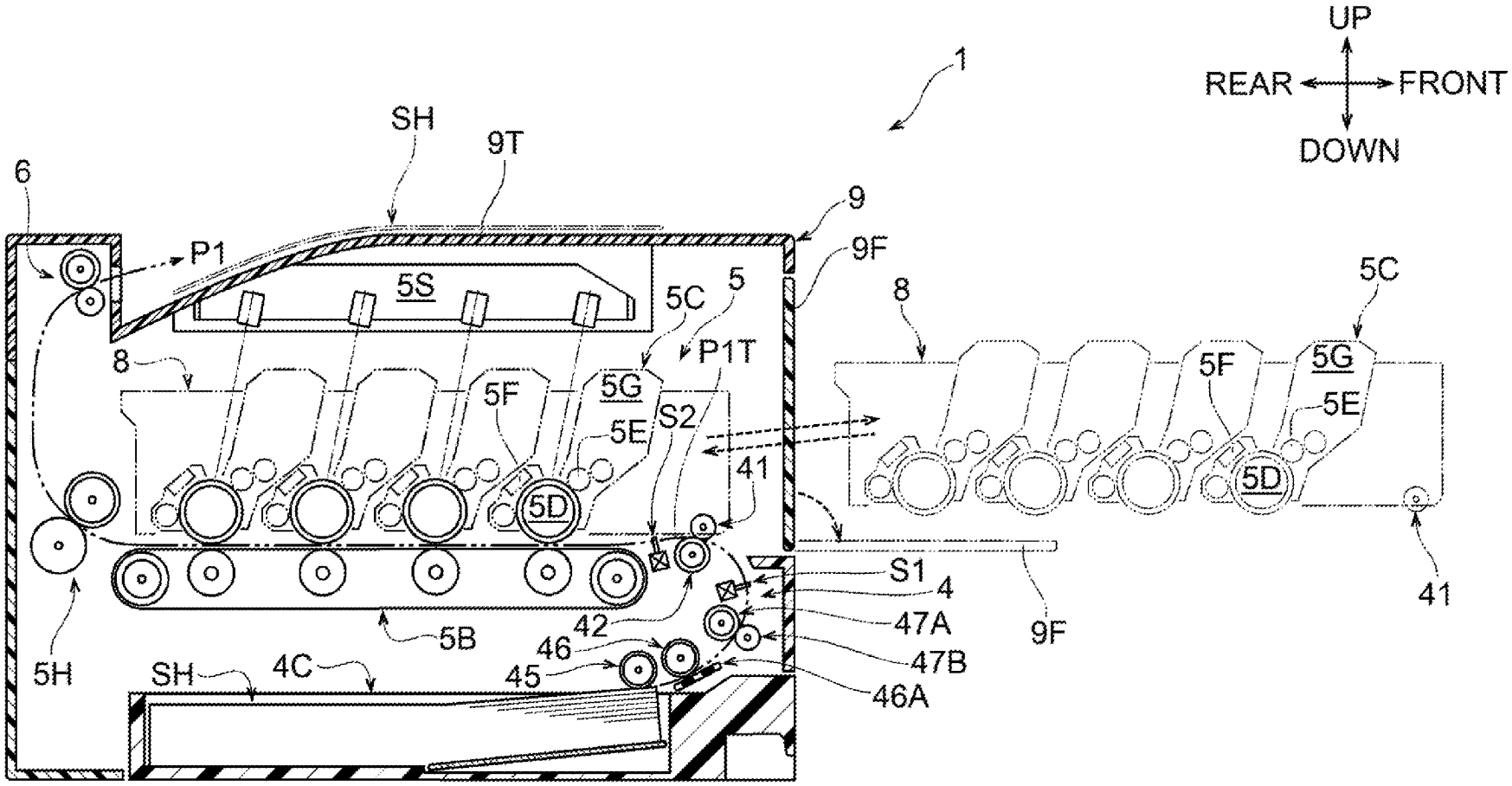
FIG. 1 is a schematic cross-sectional view of an image forming apparatus according to a first embodiment of the disclosure.

FIG. 1 shows an image forming apparatus 1 according to a first embodiment of the disclosure. The image forming apparatus 1 is a laser printer for electrophotographically forming an image on a sheet.

Figure 2:
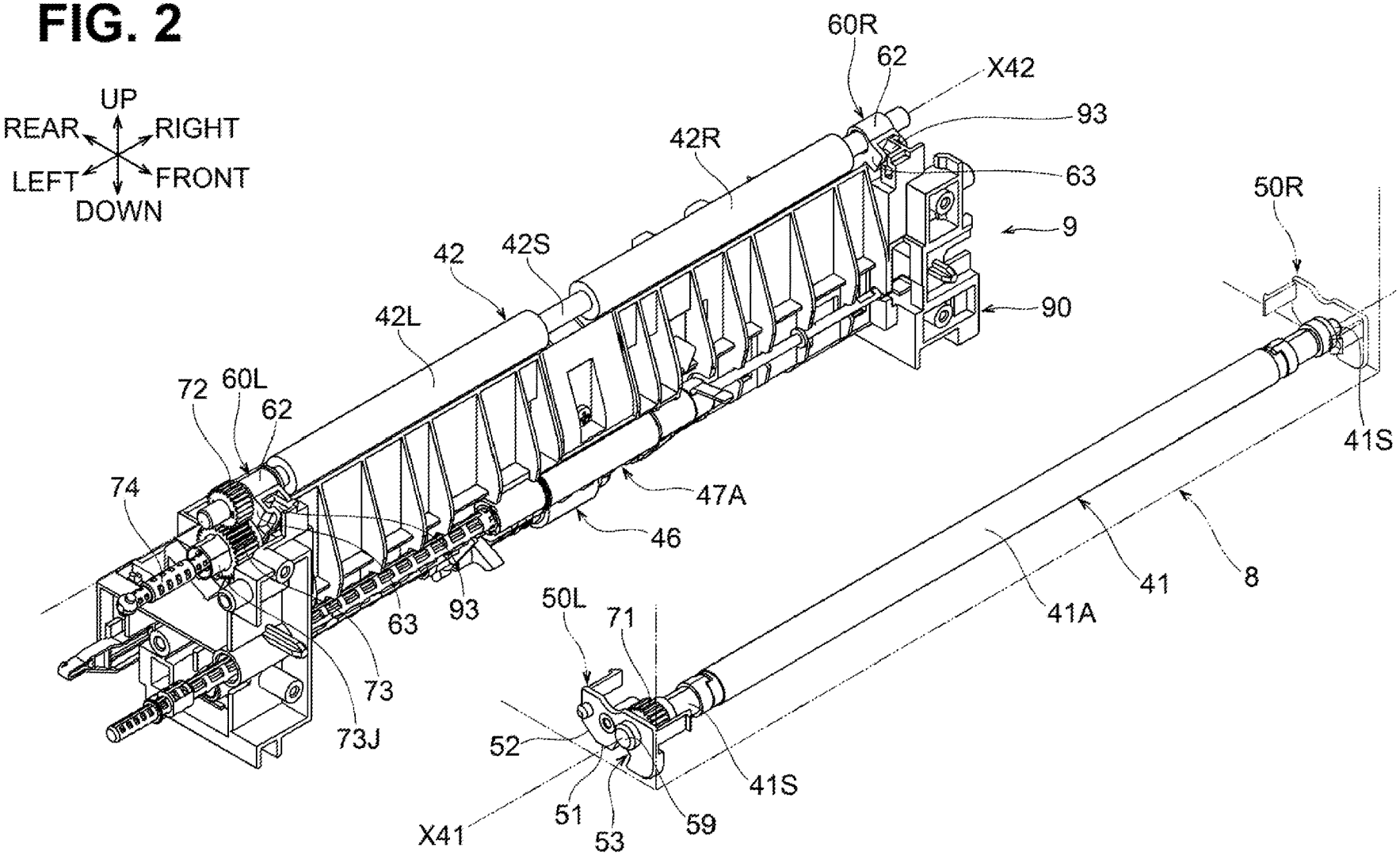
FIG. 2 is a partial perspective view of a drawer, a first holder, a first roller, a frame, a second holder, and a second roller of the image forming apparatus.
Figure 3:
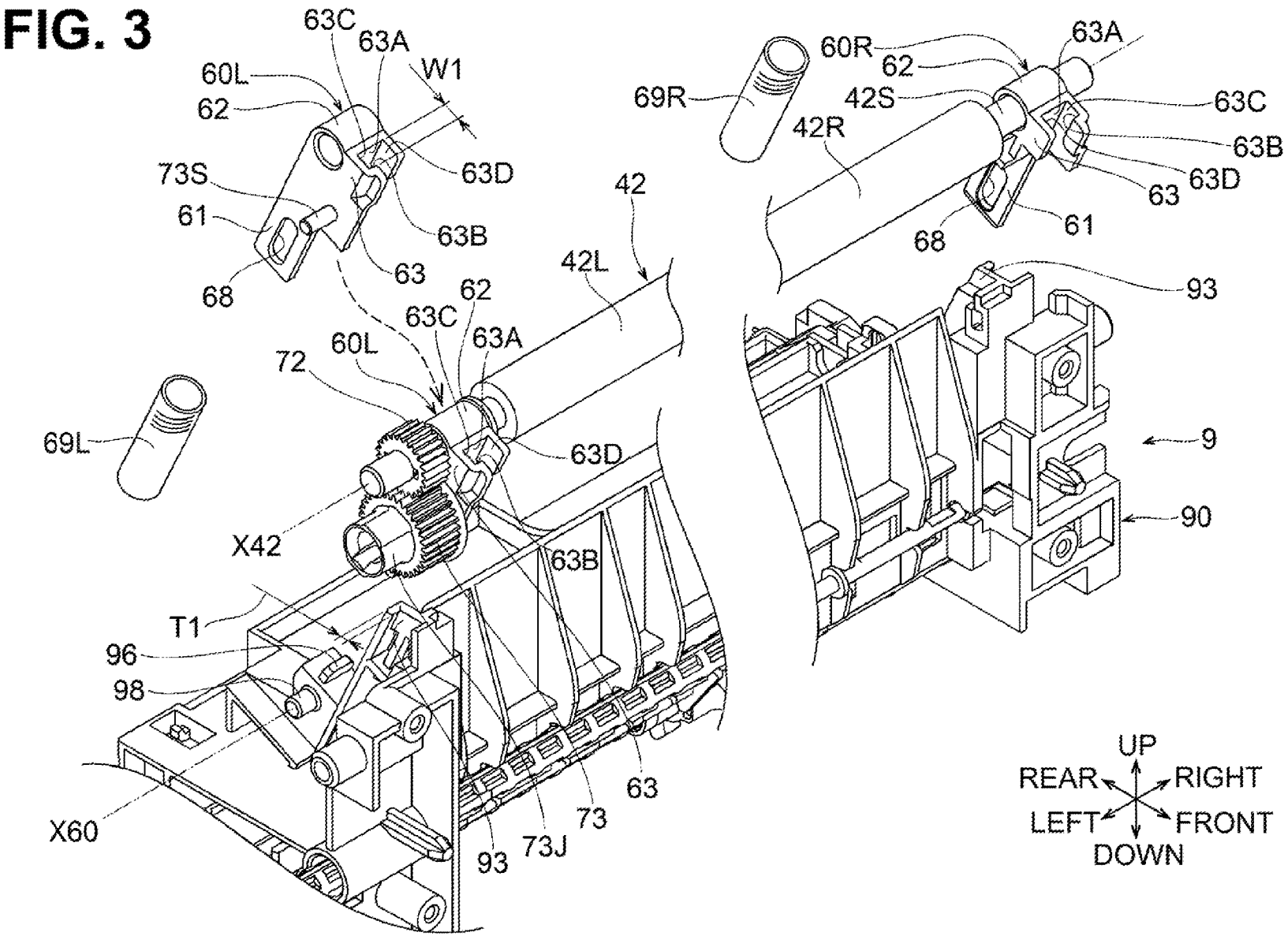
FIG. 3 is an exploded perspective view of a structure for holding the second roller, showing the frame, the second holder, the second roller, a second gear, a third gear, compressed coil springs.

A front-rear direction and an up-down direction are shown in FIG. 1 by defining right and upper sides of the page of FIG. 1 as front and upper sides of the image forming apparatus 1, respectively. A front-rear direction and an up-down direction shown in FIG. 2 and subsequent drawings correspond to the directions shown in FIG. 1. A left-right direction is shown in FIGS. 2 and 3 by defining a side facing out of the page of FIG. 1 as a left side of the apparatus. Elements of the image forming apparatus 1 will now be described with reference to FIG. 1 and other drawings.

Overall Structure of Image Forming Apparatus

As shown in FIG. 1, the image forming apparatus 1 includes a housing 9, a sheet tray 4C, a feeder 4, an image forming unit 5, and a discharge unit 6.

The housing 9 includes a plurality of inner frames (not shown). A frame 90 shown in FIGS. 2 and 3 is one of the inner frames.

As shown in FIG. 1, the sheet tray 4C is disposed at the bottom of the housing 9. The sheet tray 4C stores therein a stack of sheets SH. A discharge tray 9T is disposed at the top of the housing 9. A sheet SH having an image formed thereon is discharged onto the discharge tray 9T.

A transport path P1 is defined in the housing 9. The transport path P1 has a substantially S shape. The transport path P1 extends from a front end of the sheet tray 4C upward to curve in a U shape, extends rearward substantially horizontally, and then extends, at the rear of the housing 9, upward in a U shape to the discharge tray 9T.

The feeder 4 includes, along the U-shaped curved portion of the transport path P1, a feed roller 45, a separation roller 46, a separation piece 46A, a transport roller 47A, a pinch roller 47B, a sensor S1, a first roller 41, a second roller 42, and a sensor S2. The U-shaped curved portion extends from the front end of the sheet tray 4C. The pinch roller 47B is pressed against the transport roller 47A.

The first roller 41 and the second roller 42, which will be described in detail later, are disposed at an upper end NT of the U-shaped curved portion which is an upstream portion of the transport path P1. The second roller 42 is disposed facing, from below, the first roller 41 and is pressed against the first roller 41.

A controller (not shown) causes the feeder 4 to feed from the sheet tray 4C one sheet SH at a time, fed by the feed roller 45 and separated by the separation roller 46 and the separation piece 46A, toward the transport roller 47A and the pinch roller 47B.

Subsequently, in the feeder 4, the transport roller 47A and the pinch roller 47B pinch the sheet SH therebetween and transport the sheet SH toward the first roller 41 and the second roller 42. In this case, the controller stops rotation of the first roller 41 and the second roller 42 until a predetermined time has elapsed after detection by the sensor S1 of a leading edge of the sheet SH transported by the transport roller 47A and the pinch roller 47B. Thereafter, the controller resumes rotating the rollers 41 and 42. The first roller 41 and the second roller 42, against which the leading edge of the sheet SH is abutted, corrects or reduces skewing of the sheet SH. Then the first roller 41 and the second roller 42 pinch and transport the sheet SH toward the image forming unit 5. The controller controls the image forming unit 5 based on a timing of the sensor S2 detecting the leading edge of the sheet SH transported by the first roller 41 and the second roller 42.

The first roller 41 and the second roller 42 are configured to align a leading edge of the sheet SH reaching the first roller 41 and the second roller 42 and then transport the sheet SH toward the image forming unit 5.

The image forming unit 5 is disposed above the sheet tray 4C in the housing 9. The sheet SH fed by the feeder 4 passes through the image forming unit 5 along a substantially horizontal portion of the transport path P1.

The image forming unit 5 is of the direct tandem type capable of color printing. The image forming unit 5 includes a drawer 8, photosensitive drums 5D, and developer cartridges 5C. The photosensitive drums 5D are each an example of a photosensitive member.

The drawer 8 has a known structure and thus is schematically shown in the drawings. The drawer 8 is a frame including side walls opposite to each other in directions facing into and out of the page of FIG. 1 and each extending in the front-rear direction, and a plurality of connectors each extending in the left-right direction to connect the opposite side walls.

Four photosensitive drums 5D, which correspond to black, yellow, magenta, and cyan toners, are rotatably supported by the drawer 8 in tandem along the substantially horizontal portion of the transport path P1.

Four developer cartridges 5C, which correspond to black, yellow, magenta, and cyan toners, are detachably held by the drawer 8 in tandem along the substantially horizontal portion of the transport path P1. Each developer cartridge 5C includes a developing roller 5E, a charger 5F, and a toner storage 5G which are disposed around a corresponding photosensitive drum 5D.

In a state where a front cover 9F is pivoted to a position shown by a two-dot chain line in FIG. 1 to be open at the front of the housing 9, the drawer 8 is movable in the front-rear direction between a housed position at which the drawer 8 is housed in the housing 9, and a shifted position at which the drawer 8 is shifted from the housed position toward an exterior of the housing 9.

In this example, the drawer 8, when at the shifted position, is removed from the housing 9 and the entire drawer 8 is outside the housing 9. When the drawer 8 moves frontward from the housed position to the shifted position, the drawer 8 traces a gently oblique upward path. When the drawer 8 moves rearward from the shifted position to the housed position, the drawer 8 traces the reverse path.

The drawer 8 located at the shifted position allows for removal of a sheet jammed in the transport path P1 and maintenance, such as replacement of the developer cartridges 5C.

The image forming unit 5 includes a transfer belt 5B, a scanner 5S, and a fixer 5H.

The transfer belt 5B is disposed below the photosensitive drums 5D to define therebetween the substantially horizontal portion of the transfer path P1. The transfer belt 5B circulates while pinching, in conjunction with the photosensitive drums 5D, a sheet being transported.

The scanner 5S includes laser emitters, a polygon mirror, lenses, and reflecting mirrors, which are known elements. The scanner 5S downwardly emits laser beams to each photosensitive drum 5D for a corresponding color of black, yellow, magenta, or cyan.

A heat roller and a pressure roller of the fixer 5H pinch a sheet SH having passed below the developer cartridges 5C, and heat and press the sheet SH.

The image forming unit 5 thus structured forms an image on a sheet SH, as described below. In each developer cartridge 5C, after the charger 5F uniformly and positively charges the surface of the photosensitive drum 5D, the scanner 5S irradiates the surface of the photosensitive drum 5D. An electrostatic latent image, which corresponds to an image to be formed on the sheet SH, is formed on the surface of the photosensitive drum 5D. Subsequently, the developing roller 5E supplies toner contained in the toner container 5G to the surface of the photosensitive drum 5D, in accordance with the electrostatic latent image. The toner held on the surface of the photosensitive drum 5D is transferred onto the sheet SH. The fixer 5H heats and presses the sheet SH with the toners transferred from the photosensitive drums 5D, thereby fixing the toners on the sheet SH.

A discharge roller and a pinch roller of the discharge unit 6, which are disposed most downstream in the transport path P1, pinch the sheet SH with the fixed toners and discharge the sheet SH onto the discharge tray 9T.

In the image forming apparatus 1, as shown in FIGS. 1 and 2, the first roller 41 is rotatably supported by the drawer 8. In contrast, as shown in FIG. 2, the second roller 42 is rotatably supported by the frame 90. The separation roller 46 and the transport roller 47A of the feeder 4 are also supported by the frame 90. Although omitted from the drawings, the feed roller 45 of the feeder 4 is also rotatably supported by the frame 90.

Figure 4:
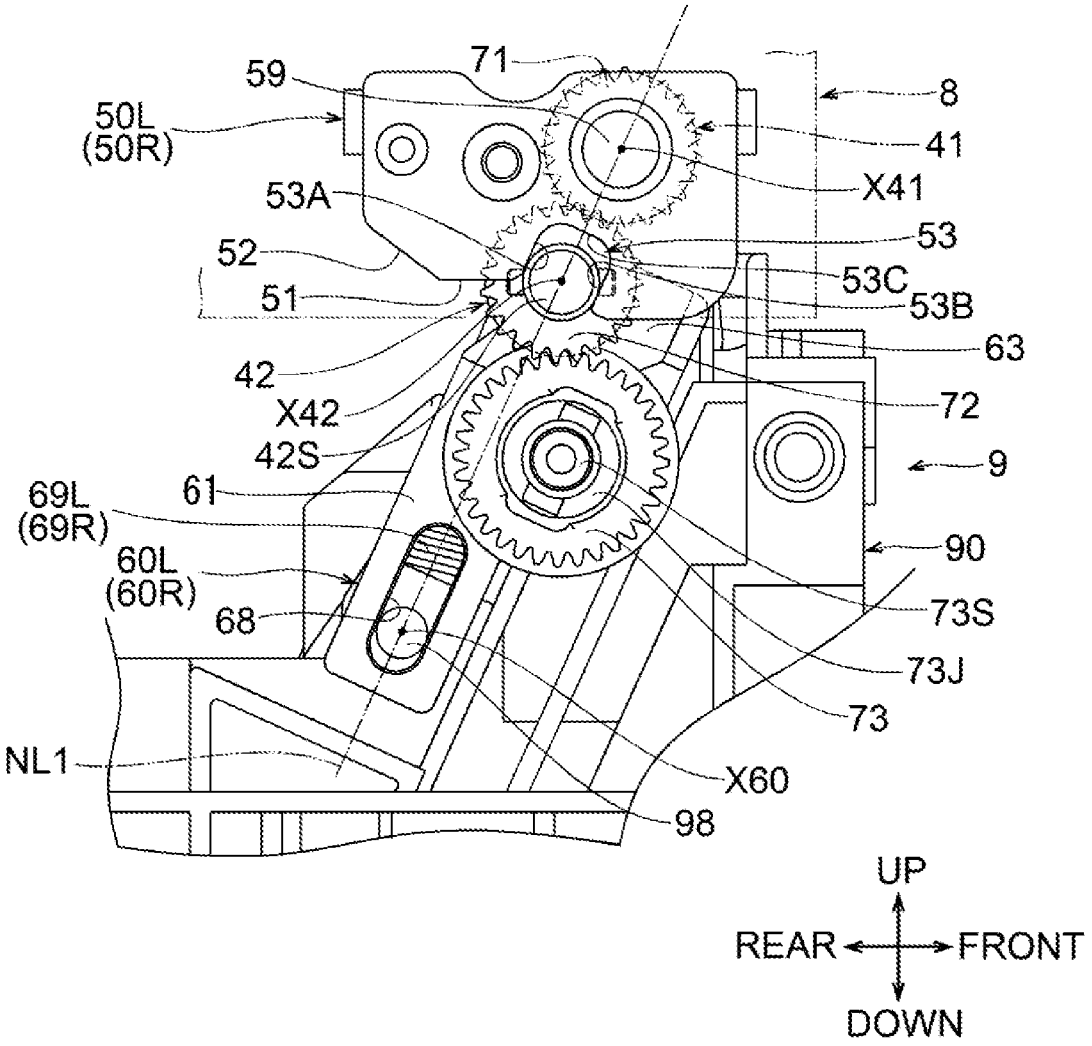
FIG. 4 is a partial side view showing a second rotation shaft of the second roller positioned by a positioner of the first holder in a state where the drawer is at a housed position.

As shown in FIGS. 1 and 2, the first roller 41 moves to an exterior of the housing 9 when the drawer 8 moves to the shifted position. As shown in FIG. 4, a first axis X41 of the first roller 41 is located further to the front than a second axis X42 of the second roller 42. Thus, the second roller 42 is unlikely to prevent the first roller 41 from moving frontward.

A nip line NL1 for the first roller 41 and the second roller 42 is defined as a straight line passing through the first axis X41 and the second axis X42 in a state where the drawer 8 is located at the housed position. The nip line NL1 is defined in a state where the first roller 41 and the second roller 42 are properly positioned as designed. When the first roller 41 and the second roller 42 are deviated from the proper positions as designed due to dimensional or assembly errors of components, a nip line for the first roller 41 and the second roller 42 is deviated from the nip line NL1.

In the image forming apparatus 1, when the drawer 8 moves from the shifted position to the housed position, the second roller 42 is positioned relative to the first roller 41 by the structure described below.

Structures of First Roller, First Holder, Positioner, First Guide, and Second Guide As shown in FIG. 2, the drawer 8 includes first holders 50L and 50R. A left first holder 50L is fixed at a lower-front corner of the left side wall of the drawer 8. A right first holder SOR is fixed at a lower-front corner of the right side wall of the drawer 8.

The left first holder 50L and the right first holder 50R are symmetrically opposite to each other and identical in shape. Hereinafter, the left first holder 50L will be mainly described and shown in the drawings and the right first holder 50R will be simply described and shown or omitted.

The first roller 41 includes a first rotation shaft 41S and a cylindrical portion 41A. The first rotation shaft 41S extends in the left-right direction along the first axis X41. The cylindrical portion 41A extends in an axial direction of the first rotation shaft 41S and is fixed to the first rotation shaft 41S to be rotatable integrally with the first rotation shaft 41S. A first gear 71 is fixed to a left end of the first rotation shaft 41S to be rotatable integrally with the first rotation shaft 41S.

The left first holder 50L includes a first bearing 59. Although omitted from the drawings, the right first holder SOR also includes a first bearing 59. The left first bearing 59 protrudes leftward from the drawer 8 and has a cylindrical shape with its end closed.

A left end of the first rotation shaft 41S is inserted in and rotatably supported by the first bearing 59 of the left first holder 50L. A right end of the first rotation shaft 41S is inserted in and rotatably supported by the first bearing 59 of the right first holder 50R.

As described above, the first roller 41 is supported by the drawer 8, via the first holders 50L and 50R, rotatably about the first axis X41. The photosensitive drums 5D and the first roller 4 are rotatably supported by the drawer 8. Thus, the positioning accuracy of the first roller 41 relative to the photosensitive drums 5D is unchanged and maintained high regardless of variations in positioning of the drawer 8 relative to the housing 9.

As shown in FIGS. 2 and 4, the left first holder 50L includes a positioner 53, a first guide 51, and a second guide 52. Although omitted from the drawings, the right first holder SOR also includes a positioner 53, a first guide 51, and a second guide 52.

As shown in FIG. 4, the positioner 53 is a recess which is recessed from a lower end of the first holder 50L (50R) upwardly into the first holder 50L (50R) along the nip line NL1. The positioner 53 includes the most recessed portion 53C, a first side end 53A, and a second side end 53B.

The most recessed portion 53C is inclined to be orthogonal to the nip line NL1 and extends in the front-rear direction. The first side end 53A is connected to a rear end of the most recessed portion 53C and extends downward along the nip line NL1. The second side end 53B is connected to a front end of the most recessed portion 53C and extends downward along the nip line NL1. The second side end 53B rearwardly faces the first side end 53A and extends to a lower position than the first side end 53A. In other words, the second side end 53B extends downwardly beyond the first side end 53A.

The first guide 51 is a portion of the lower end of the first holder 50L (50R) and is connected to a lower end of the first side end 53A of the positioner 53. The first guide 51 is located opposite to the second side end 53B relative to the first side end 53A. The first guide 51 extends rearward and relatively horizontally at a position above a lower end of the second side end 53B of the positioner 53.

The second guide 52 is a portion of the lower end of the first holder 50L (50R) and is located further to the rear than the first guide 51. As the second guide 52 extends toward the front, the second guide 52 is inclined downwardly toward the first guide 51 and is connected to a lower end of the first guide 51.

Structures of Second Roller, Second Holder, and Compressed Coil Spring

A description will be made on a structure for holding the second roller 42.

As shown in FIGS. 2 and 3, the second roller 42 includes a second rotation shaft 42S, a first cylindrical portion 42L, and a second cylindrical portion 42R. The second rotation shaft 42S extends in the left-right direction along a second axis X42. The first cylindrical portion 42L and the second cylindrical portion 42R extend in an axial direction of the second rotation shaft 42S and are fixed to the second rotation shaft 42S to be rotatable integrally with the second rotation shaft 42S. The first cylindrical portion 42L and the second cylindrical portion 42R are spaced from each other in the left-right direction by a predetermined distance. A second gear 72 is fixed to a left end of the second rotation shaft 42S to be rotatable integrally with the second rotation shaft 42S.

The housing 9 includes second holders 60L and 60R via which the second roller 42 is rotatably supported by the frame 90. As shown in FIG. 3, a left second holder 60L and a right second holder 60R are symmetrically opposite to each other and similar in shape. The left second holder 60L includes a third rotation shaft 73S while the right second holder 60R does not. Hereinafter, the left second holder 60L will be mainly described and shown in the drawings and the right second holder 60R will be simply described and shown or omitted.

Each of the second holders 60L and 60R includes a flat plate 61, a second bearing 62, and a guide 63.

As shown in FIGS. 3 and 4, the flat plate 61 is substantially rectangular and extends along the nip line NL1. The flat plate 61 has a slot 68 formed through its lower portion in the left-right direction. The slot 68 extends along the nip line NL1.

The flat plate 61 of the left second holder 60L includes the third rotation shaft 73S. The third rotation shaft 73S is a cylindrical shaft protruding leftward from a position above the slot 68 and further to the front than the slot 68. The third rotation shaft 73S rotatably supports a third gear 73. A substantially cylindrical connector 73J protrudes leftward from a left side of the third gear 73.

As shown in FIG. 3, the second bearing 62 is connected to an upper end portion of the flat plate 61 and formed into a cylinder having a round through-hole extending in the left-right direction.

A left end of the second rotation shaft 42S is inserted in the second bearing 62 of the left second holder 60L. Specifically, the left end of the second rotation shaft 42S is located between the second gear 72 and the first cylindrical portion 42L. A right end of the second rotation shaft 42S is inserted in the second bearing 62 of the right second holder 60R.

The second holders 60L and 60R rotatably supports the second rotation shaft 42S of the second roller 42.

In this state, the left end of the second rotation shaft 42S protrudes leftward beyond the second bearing 62 and the second gear 72. The left end of the second rotation shaft 42S is fittable into the positioner 53 of the left first holder 50L. The right end of the second rotation shaft 42S protrudes rightward beyond the second bearing 62. A right end of the second rotation shaft 42S is fittable into the positioner 53 of the right first holder 50R.

In this state, the third gear 73 rotatably supported by the third rotation shaft 73S of the left second holder 60L is meshed with the second gear 72. As shown in FIG. 2, a right end of a coupling 74 is connected to the connector 73J of the third gear 73.

A drive source (not shown) is connected to a left end of the coupling 74 via a plurality of gears and the like. A drive force of the drive source is transmitted, via the coupling 74, the third gear 73, and the second gear 72, to the second rotation shaft 42S.

The connector 73J is configured to transmit the drive force of the drive source from the coupling 74 to the third gear 73 even when the coupling 74 is tilted relative to an axial direction of the third gear 73.

As shown in FIG. 3, each guide 63 is connected to a front side of a corresponding second bearing 62. Each guide 63 is C-shaped in section and has, on its inside, front-rear restriction surfaces 63A and 63B and left-right restriction surfaces 63C and 63D. The front-rear restriction surfaces 63A and 63B define an inside width W1 therebetween. The front-rear restriction surface 63A and 63B and the left-right restriction surface 63C and 63D extend along the nip line NL1.

As shown in FIG. 3, the frame 90 has, at its left and right end portions, rails 93. The left rail 93 and the right rail 93 are symmetrically opposite to each other and identical in shape.

Each rail 93 is L-shaped in section and extends along the nip line NL1. As shown in FIG. 3, the left rail 93 includes a rib protruding leftward and having a plate thickness T1. The inside width W1 between the front-rear restriction surfaces 63A and 63B is set to be greater, to some extent, than the plate thickness T1.

The frame 90 has, at each of its left and right end portions, a shaft 98 and a spring holder 96. The shaft 98 and the spring holder 96 on the left end portion, and the shaft 98 and the spring holder 96 on the right end portion are symmetrically opposite to each other and identical in shape. Thus, the shaft 98 and the spring holder 96 on the left end portion of the frame 90 are shown in the drawings and those on the right end portion of the frame 90 are omitted from the drawings.

The shaft 98 is cylindrical and protrudes leftward from a position lower and further to the rear than the rail 93. As shown in FIG. 4, the shaft 98 has an axis serving as the pivot axis X60. The nip line NL1 passes through the pivot axis X60. The pivot axis X60 is located opposite to the first axis X41 of the first roller 41 relative to the second axis X42 of the second roller 42 and extends in the left-right direction.

As shown in FIG. 3, the spring holder 96 includes an inclined surface formed above the shaft 98 and below the rail 93, and a protrusion protruding upward from the inclined surface.

As shown in FIG. 2, the rail 93 at the left end portion of the frame 90 is inserted in the guide 63 of the left second holder 60L. The rail 93 at the right end portion of the frame 90 is inserted in the guide 63 of the right second holder 60R.

As shown in FIG. 3, the inside width W1 between the front-rear restriction surfaces 63A and 63B is set to be greater, to some extent, than the plate thickness T1 of the rib of the rail 93. This allows the guide 63 to move in the front-rear direction relative to the rail 93.

A clearance between the left restriction surface 63C and the rail 93, and a clearance between the right restriction surface 63D and the rail 93 are set to be small, thereby restricting rattling of the guide 63 in the left-right direction relative to the rail 93.

As shown in FIG. 4, the shaft 98 at the left end portion of the frame 90 is inserted and located in the slot 68 of the left second holder 60L. Although omitted from the drawings, the shaft 98 at the right end portion of the frame 90 is inserted in the slot 68 of the right second holder 60R.

Figure 5:
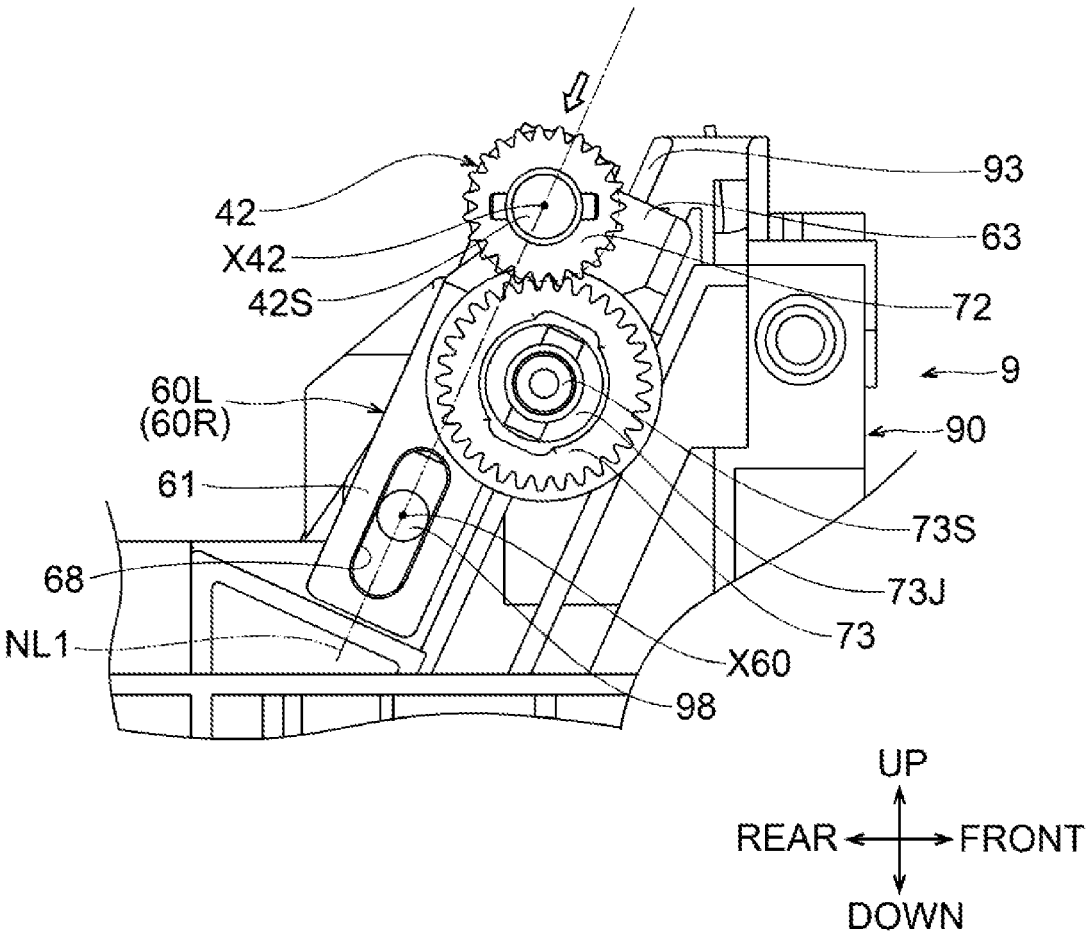
FIG. 5 is a partial side view of the second holder moving linearly relative to a housing.
Figure 6:
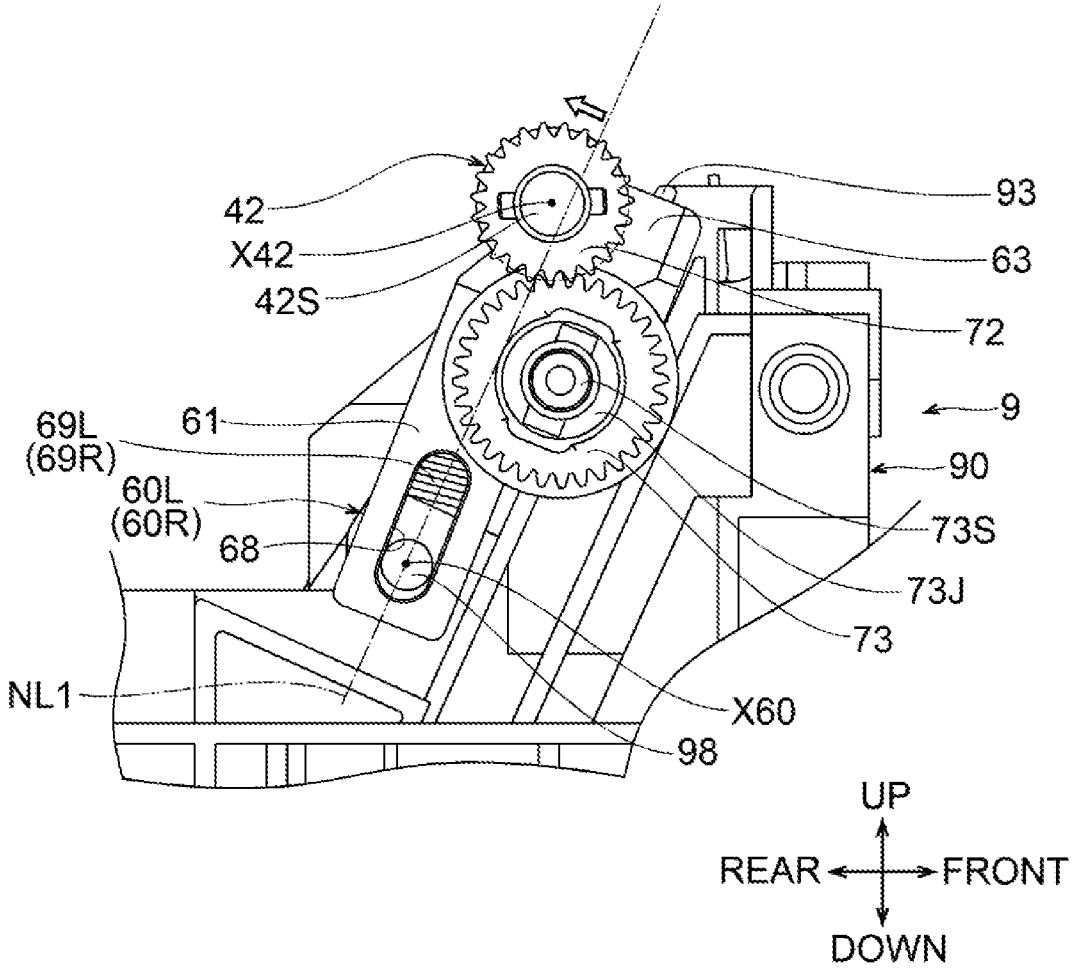
FIG. 6 is a partial side view of the second holder pivoting rearward relative to the housing.
Figure 7:
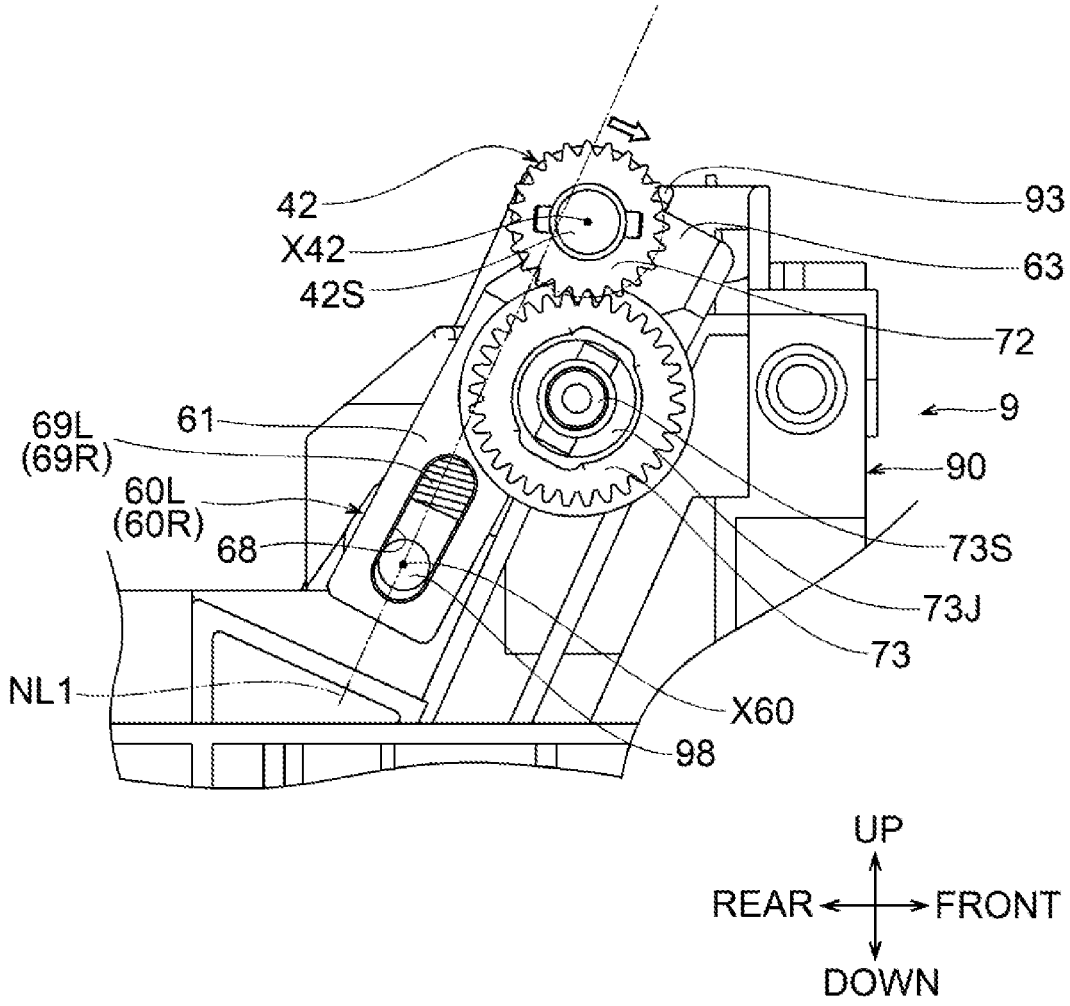
FIG. 7 is a partial side view of the second holder pivoting frontward relative to the housing.

Thus, the second holders 60L and 60R are supported by the housing 9 to be movable linearly along the nip line NL1, as shown in FIGS. 4 and 5, and to be pivotable about the pivot axis X60, as shown in FIGS. 6 and 7.

The second roller 42 is supported by the housing 9, via the second holders 60L and 60R thus structured, rotatably and movably relative to the first roller 41.

As shown in FIG. 3, the image forming apparatus 1 includes compressed coil springs 69L and 69R. The compressed coil springs 69L and 69R are each an example of an urging member.

A lower end of a left compressed coil spring 69L is held by the spring holder 96 at the left end portion of the frame 90. An upper end of the left compressed coil spring 69L contacts, from below, the second bearing 62 of the left second holder 60L. A lower end of a right compressed coil spring 69R is held by the spring holder 96 (not shown) at the right end portion of the frame 90. An upper end of the right compressed coil spring 69R contacts, from below, the second bearing 62 of the right second holder 60R. The compressed coil springs 69L and 69R apply to the second rotation shaft 42S of the second roller 42 an urging force acting upward along the nip line NL1 shown in FIG. 4.

The second roller 42 is urged by the compressed coil springs 69L and 69R thus structured, upward and frontward, toward the first roller 41.

Action of Positioner, First Guide, and Second Guide

As shown in FIG. 4, when the drawer 8 is located at the housed position, opposite ends of the second rotation shaft 42S of the second roller 42 are fitted and located in the positioners 53 of the first holders 50L and 50R. Thus, the positioners 53 position the second roller 42 relative to the first roller 41.

In this case, contact between the cylindrical portion 41A of the first roller 41 and the first and second cylindrical portions 42L and 42R of the second roller 42, restricts a fitting depth to which the second rotation shaft 42S fits into the positioners 53. While the most recessed portion 53C of each positioner 53 faces an upper end of the second rotation shaft 42S, the first side end 53A and the second side end 53B of each positioner 53 sandwich the second rotation shaft 42S to thereby reduce rattling of the second rotation shaft 42S in the front-rear direction.

In this case, the first guide 51 of each positioner 53 is located below an upper end of the second rotation shaft 42S fitted and located in the positioner 53.

In a state where the drawer 8 is located at the housed position, the first gear 71 and the second gear 72 are meshed with each other. Thus, a drive force of the drive source (not shown) is transmitted, via the coupling 74, the third gear 73, and the second gear 72, to the first gear 71. Accordingly, the first roller 41 and the second roller 42 are driven to rotate.

When the first roller 41 moves toward an exterior of the housing 9 in response to movement of the drawer 8 from the housed position toward the shifted position, the second holder 60L (60R) is urged by the compressed coil spring 69L (69R) to move up along the nip line NL1, as shown by way of example in FIGS. 6 and 7. In this case, the shaft 98 is located near a lower end of the slot 68.

Figure 8:
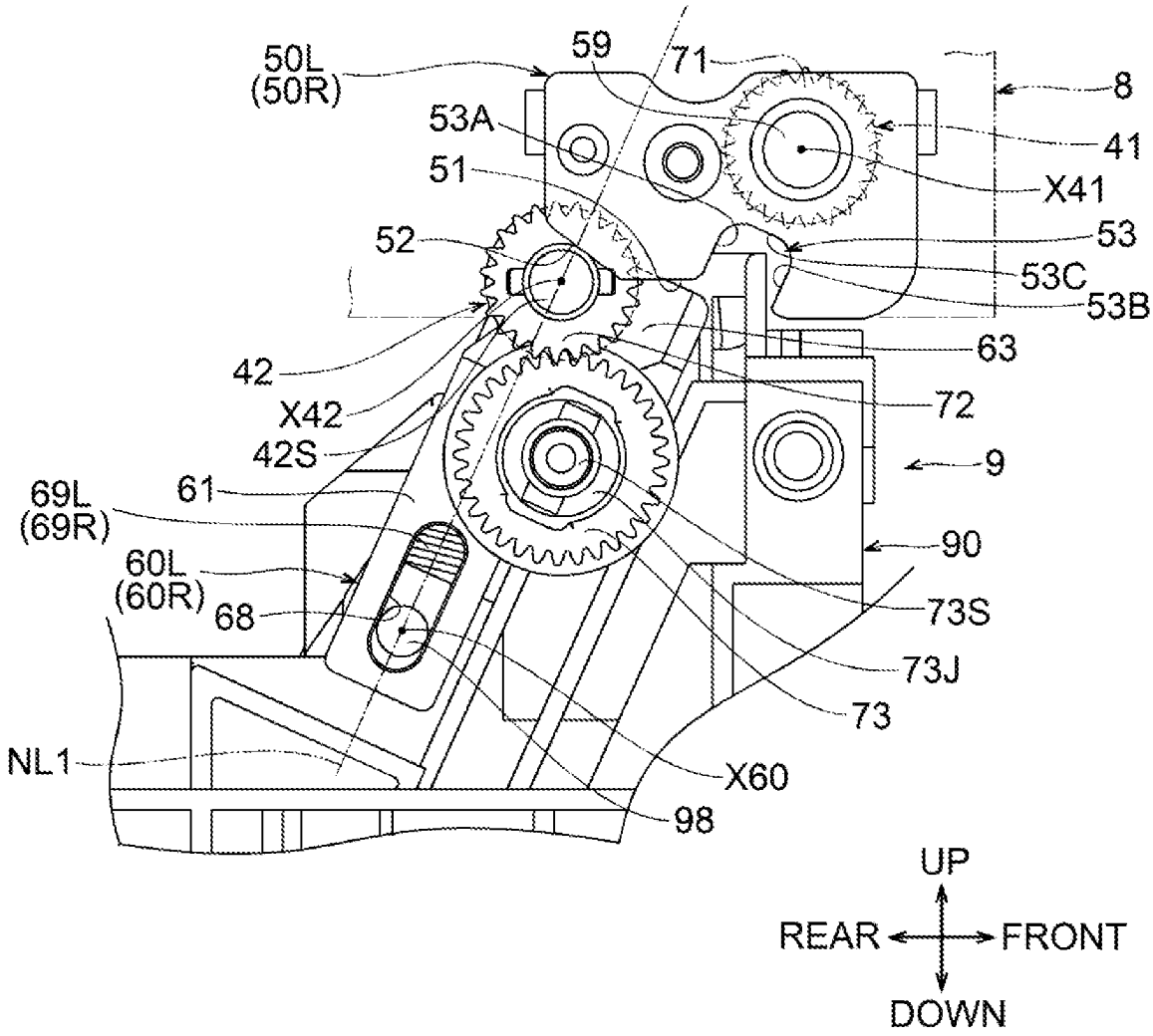
FIG. 8 is a partial side view of the second rotation shaft of the second roller guided by a second guide of the first holder when the drawer moves.

As shown in FIG. 8, when the first roller 41 approaches the second roller 42 in response to movement of the drawer 8 from the shifted position toward the housed position, the second guide 52 contacts from above the second rotation shaft 42S before the first guide 51 does. When the drawer 8 moves further toward the housed position, the second guide 52 slidably contacts the second rotation shaft 42. Thus, the second holder 60L (60R) and the second roller 42 gradually move down along the nip line NL1 against the urging force of the compressed coil spring 69L (69R).

Figure 9:
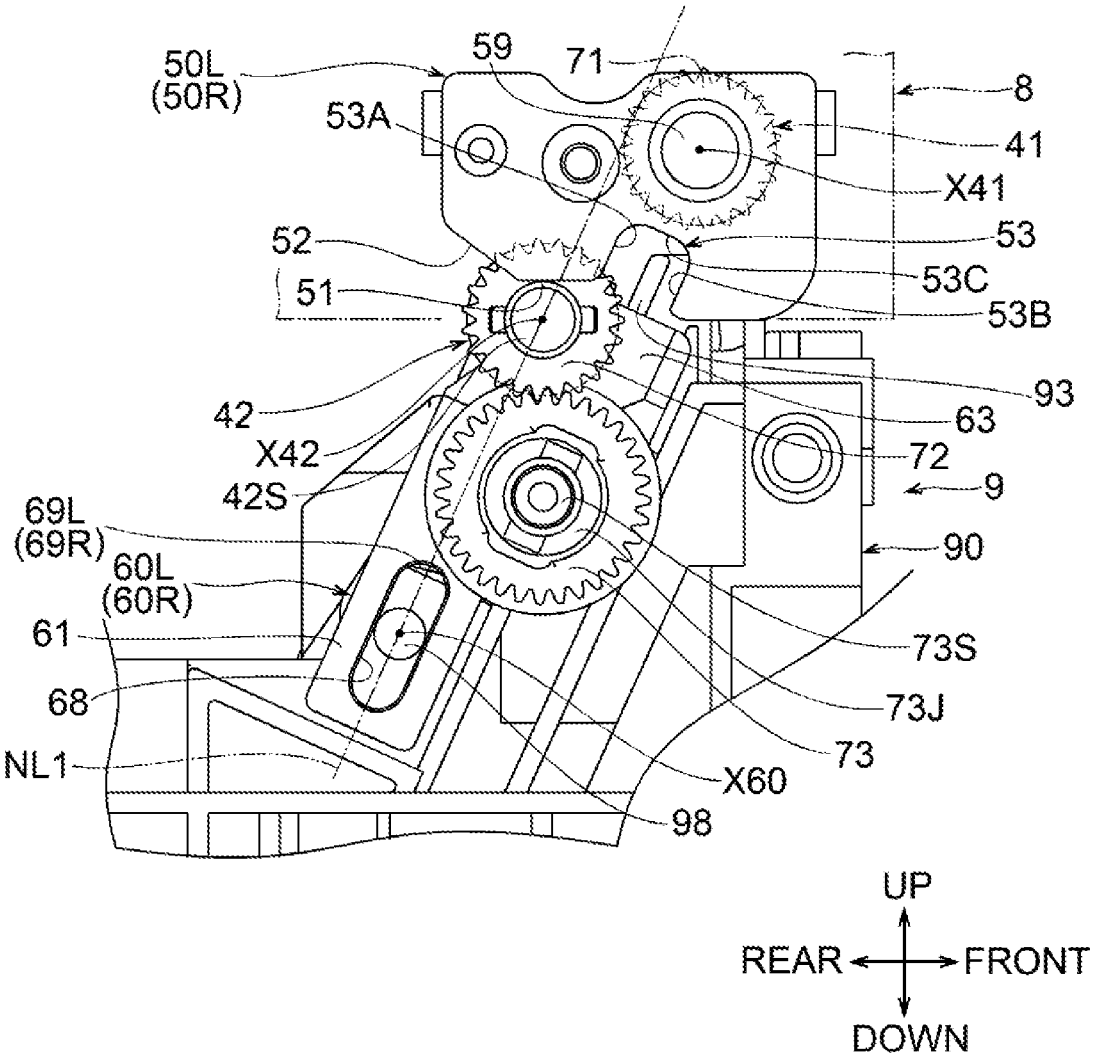
FIG. 9 is a partial side view of the second rotation shaft of the second roller guided by a first guide of the first holder when the drawer moves.

As shown in FIG. 9, when the drawer 8 moves further toward the housed position, the second guide 52 moves rearward away from the second rotation shaft 42S, and then the first guide 51 slidably contacts from above the second rotation shaft 42S. The first guide 51 slidably contacts from above the second rotation shaft 42S before the positioner 53 positions the second rotation shaft 42S.

As shown in FIG. 4, when the drawer 8 reaches the housed position, the first guide 51 moves rearward away from the second rotation shaft 42S, and the second rotation shaft 42S is urged by the compressed coil spring 69L (69R) to fit into the positioner 53. The second side end 53B located further to the front receives and stops the second rotation shaft 42S. The second roller 42 disposed at the housing 9 is positioned relative to the first roller 41 disposed at the drawer 8 regardless of variations in positioning of the drawer 8 relative to the housing 9.

When the drawer 8 moves from the housed position to the shifted position, the first guide 51 and the second guide 52 act on the second rotation shaft 42S in a manner reverse to the above, and thus a description will be omitted.

Effects

In the image forming apparatus 1 according to aspects of the disclosure, as shown in FIG. 1, the drawer 8 rotatably supports the four photosensitive drums 5D and the first roller 41. The positioning accuracy of the first roller 41 relative to the photosensitive drums 5D is unchanged and maintained high regardless of variations in positioning of the drawer 8 relative to the housing 9. As shown in FIGS. 4 to 9, the second roller 42 is movable by the second holder 60L (60R) and the compressed coil spring 69L (69R) relative to the first roller 41. As shown in FIG. 4, when the drawer 8 moves from the shifted position to the housed position, the second rotation shaft 42S of the second roller 42 is positioned by the positioner 53 of the first holder 50L (50R) relative to the first roller 41.

In short, in the image forming apparatus 1, the second roller 42 disposed at the housing 9 moves toward the first roller 41 disposed at the drawer 8, regardless of variations in positioning of the drawer 8 relative to the housing 9. This may improve the accuracy in positioning the second roller 42 relative to the photosensitive drums 5D, and prevent the second roller 42 from being positioned skewly relative to the photosensitive drums 5D. Accordingly, sheet skew may be prevented or reduced when the first roller 41 and the second roller 42 pinch a sheet SH therebetween and transport the sheet SH toward the photosensitive drums 5D. As a result, image skew relative to the sheet SH may be prevented or reduced in the image forming apparatus 1.

Thus, the image forming apparatus 1 according to aspects of the disclosure may achieve image forming with an improved accuracy.

In the image forming apparatus 1, as shown in FIG. 4, the second rotation shaft 42S of the second roller 42 fits directly, not via a bearing or the like, in the positioner 53 which is a recess formed in the first holder 50L (50R). This may allow for accurate positioning of the second rotation shaft 42S of the second roller 42 relative to the first rotation shaft 41S of the first roller 41, leading to the improvement of the positioning accuracy of the second roller 42 relative to the photosensitive drum 5D.

In the image forming apparatus 1, as shown in FIG. 4, the first guide 51 is located below the upper end of the second rotation shaft 42S fitted and located in the positioner 53. As shown in FIG. 9, when the drawer 8 moves from the shifted position toward the housed position, the second rotation shaft 42S of the second roller 42 is pushed down by the first guide 51 and then is urged by the compressed coil spring 69L (69R) to fit into the positioner 53. This may prevent frictional contact between the first roller 41 and the second roller 42 during movement of the drawer 8, thereby reducing local abrasion of the first roller 41 and the second roller 42.

In the image forming apparatus 1, as shown in FIG. 4, in a state where the drawer 8 is located at the housed position, the first gear 71 fixed to the first rotation shaft 41S of the first roller 41 is meshed with the second gear 72 fixed to the second rotation shaft 42S of the second roller 42. As described above, when the drawer 8 moves from the shifted position toward the housed position, the second rotation shaft 42S of the second roller 42 is pushed down by the first guide 51 and then is urged by the compressed coil spring 69L (69R) to fit into the positioner 53. This may prevent frictional contact between the first gear 71 and the second gear 72 during movement of the drawer 8, thereby reducing local abrasion of the first gear 71 and the second gear 72.

In the image forming apparatus 1, as shown in FIG. 8, when the drawer 8 moves from the shifted position toward the housed position, the second rotation shaft 42S of the second roller 42 is gradually pushed down by the second guide 52, which is inclined downwardly toward the first guide 51, and then is guided by the first guide 51. This may reduce an abrupt increase in resistance when the drawer 8 moves from the shifted position to the housed position. Thus, the drawer 8 moves smoothly to the housed position in the image forming apparatus 1.

In the image forming apparatus 1, as shown in FIG. 4, when the drawer 8 reaches the housed position, the second rotation shaft 42S fitting into the positioner 53 is reliably stopped by the second side end 53B which extends downwardly beyond the first side end 53A. This may further improve the positioning accuracy of the second roller 42 relative to the photosensitive drums 5D in the image forming apparatus 1.

In the image forming apparatus 1, as shown in FIGS. 5 to 7, the second holder 60L (60R), which is supported movably relative to the housing 9, rotatably supports the second rotation shaft 42S of the second roller 42. The second gear 72 is fixed to the second rotation shaft 42S to be rotatable integrally with the second rotation shaft 42S. As shown in FIG. 3, the left second holder 60L rotatably supports the third gear 73 which meshes with the second gear 72 to transmit a drive force to the second rotation shaft 42S. The second holder 60L (60R) thus structured allows the second roller 42 to properly move toward the first roller 41. Movement of the second roller 42 toward the first roller 41 does not change the positional relation between the second gear 72 and the third gear 73. Thus, a drive force is properly transmitted, via the third gear 73 and the second gear 72, to the second rotation shaft 42S of the second roller 42. Accordingly, the first roller 41 and the second roller 42 pinch a sheet SH therebetween and transport the sheet SH smoothly toward the photosensitive drums 5D.

In the image forming apparatus 1, as shown in FIG. 2, the coupling 74 is connected to the connector 73J of the third gear 73. When the third gear 73 moves together with the left second holder 60L as the second roller 42 moves toward the first roller 41, the coupling 74 properly transmits a drive force, via the third gear 73 and the second gear 72, to the second rotation shaft 42S of the second roller 42.

In the image forming apparatus 1, as shown in FIGS. 5 to 7, the second holder 60L (60R) is supported by the housing 9 to be movable linearly along the nip line NL1 and pivotable about the pivot axis X60. Thus, the second holder 60L (60R) allows the second roller 42 to properly move toward the first roller 41.

In the image forming apparatus 1, as shown in FIGS. 3 and 4, linear movement and pivoting of the second holder 60L (60R) are readily achieved by the shaft 98 of the frame 90 inserted in the slot 68 in the second holder 60L (60R). The nip line NL passes through the pivot axis X60. This may prevent the second roller 42 from deviating unevenly from the nip line NL when the second holder 60L (60R) pivots about the pivot axis X60 rearward (shown in FIG. 6) and frontward (shown in FIG. 7).

In the image forming apparatus 1, as shown in FIG. 1, the first roller 41 and the second roller 42 are disposed at the upper end PIT of the curved portion of the transport path P1. The first roller 41 is immovable when the first roller 41 receives a pressing force from a sheet SH passing the upper end NT of the curved portion. The second roller 42 moves toward the first roller 41, thereby properly transporting the sheet SH toward the photosensitive drums 5D.

In the image forming apparatus 1, as shown in FIG. 1, the first roller 41 and the second roller 42, which serve as the registration rollers, advantageously meets the requirement for high accuracy in positioning the registration rollers relative to the photosensitive drums 5D.

A description will be made on an image forming apparatus, especially on a structure for holding a second roller 42, according to a second embodiment. In the second embodiment, elements shown and described in the first embodiment are designated by the same reference numerals, and thus the description thereof will be omitted.

Figure 10:
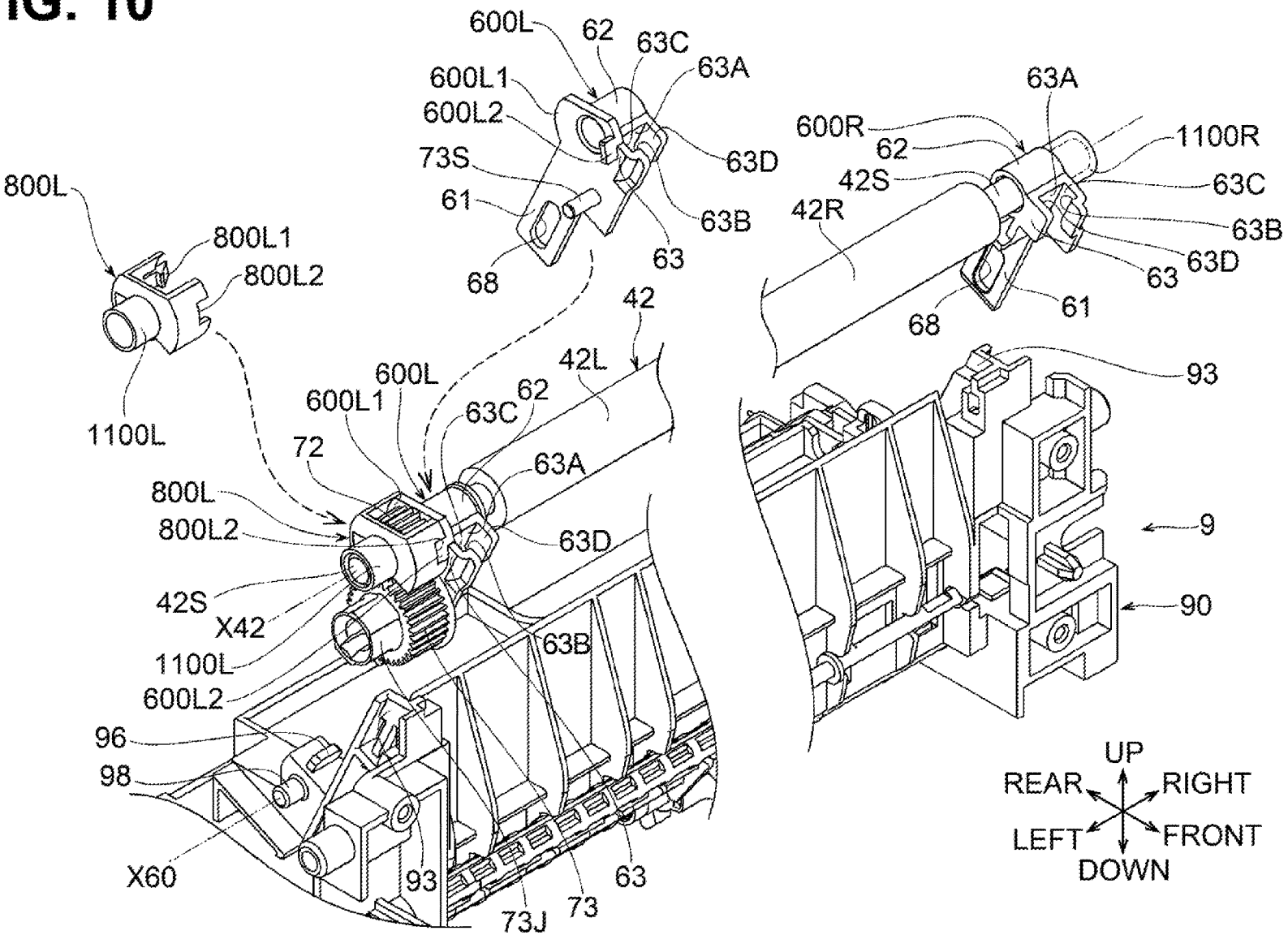
FIG. 10 is an exploded perspective view of a structure for holding a second roller, showing a frame, a gear cover with a sleeve, a left second holder to which the gear cover is assembled, a right second holder with a sleeve, and a second gear according to an image forming apparatus of a second embodiment.
Figure 11:
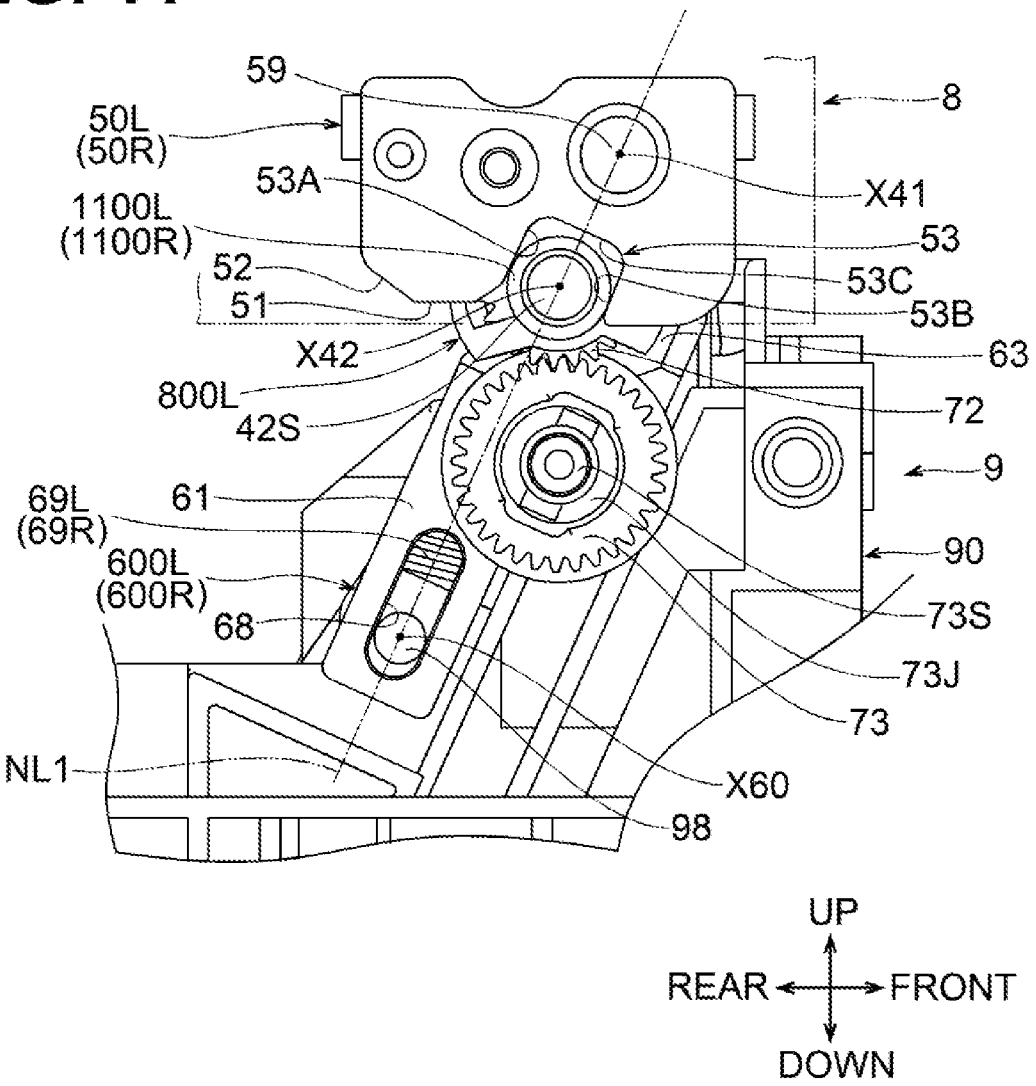
FIG. 11 is a partial side view showing the sleeve of the gear cover pinched between a second rotation shaft of the second roller and a positioner of a first holder, and the second rotation shaft positioned by the positioner in a state where the drawer is at the housed position according to the image forming apparatus of the second embodiment.

As shown in FIGS. 10 and 11, the image forming apparatus of the second embodiment uses second holders 600L, 600R instead of the second holders 60L, 60R of the first embodiment, and a gear cover 800L to be assembled to a left second holder 600L for covering the second gear 72.

The second holder 600L includes a rib 600L1 and a protrusion 600L2, in addition to the elements of the second holder 60L of the first embodiment. Other elements of the second holder 600L are the same as those of the second holder 60L.

The gear cover 800L includes a sleeve 1100L, a hook 800L1, and a recess 800L2. The sleeve 1100L covers a left end of the second rotation shaft 42S. The hook 800L1 engages with the rib 600L1 of the second holder 600L to fix the gear cover 800L to the second holder 600L. The sleeve 1100L is an example of a covering member. The recess 800L2 engages with the protrusion 600L2 of the second holder 600L to lock the gear cover 800L together with the hook 800L1.

A right second holder 600R includes a sleeve 1100R, in addition to the elements of the second holder 60R of the first embodiment. The sleeve 1100R is integral with the second holder 600R and covers a right end of the second rotation shaft 42S. Other elements of the second holder 600R are the same as those of the second holder 60R.

As shown in FIG. 11, a positioner 53 of a left first holder 50L is a recess which is recessed from a lower end of the first holder 50L upwardly into the first holder 50L along the nip line NL1. The recess is sized to receive the sleeve 1100L covering the end of the second rotation shaft 42S. In a state where the drawer 8 is located at the housed position, the sleeve 1100L covering the left end of the second rotation shaft 42S is fitted and located in the positioner 53 of the first holder 50L. Thus, the positioner 53 positions the second rotation shaft 42S relative to the first roller 41.

While the second rotation shaft 42S rotates, the sleeve 1100L is unable to rotate by the hook 800L1 and the recess 800L2 engaging with the second holder 600L, and thus remains stationary relative to the positioner 53.

Although omitted from the drawings, a positioner 53 of a right first holder SOR is also a recess sized to receive the sleeve 1100R. In a state where the drawer 8 is located at the housed position, the sleeve 1100R covering a right end of the second rotation shaft 42S is fitted and located in the positioner 53 of the first holder 50R. Thus, the positioner 53 positions the second rotation shaft 42S relative to the first roller 41.

While the second rotation shaft 42S rotates, the sleeve 1100R, which is integral with the second holder 600R, is unable to rotate, and thus remains stationary relative to the positioner 53.

This may improve the positioning accuracy of the second roller 42 relative to the photosensitive drums 5D in the image forming apparatus of the second embodiment, as is the case with the image forming apparatus of the first embodiment. Thus, the image forming apparatus of the second embodiment may also achieve image forming with an improved accuracy.

In the second embodiment, while the second rotation shaft 42S rotates, the sleeve 1100L remains stationary relative to the positioner 53. Thus, friction is unlikely to act between the second rotation shaft 42S and the positioner 53 in a direction against the urging force of the compressed coil spring 69L (69R) or in a direction in which the second rotation shaft 42S comes off the positioner 53. This stabilizes the position of the second rotation shaft 42S.

While the disclosure has been described with reference to particular examples, various changes, arrangements and modifications may be applied therein without departing from the spirit and scope of the disclosure.

In the above-described embodiments, the photosensitive drum 5D is rotatably supported directly by the drawer 8 but is not limited to this structure. For example, the photosensitive drum 5D may be rotatably supported by the drawer 8 via an additional element. Specifically, the photosensitive drum 5D may be rotatably supported by a process cartridge which may be supported by the drawer 8.

In the above-described embodiments, the first roller 41 is rotatably supported by the first holder 50L (50R) and the first holder 50L (50R) is supported by the drawer 8 but is not limited to this structure. For example, the drawer 8 may include a bearing integrally formed with the drawer 8 and the first roller 41 may be rotatably supported by the bearing such that the first roller 41 is supported directly by the drawer 8.

In the above-described embodiments, the second roller 42 is movable linearly along the nip line NL1 and pivotable about the pivot axis X60 but is not limited to this structure. For example, the second roller 42 may be movable linearly or pivotable, relative to the first roller 41.

In the above-described embodiments, the drawer 8 when at the shifted position, is removed from the housing 9 and the entire drawer 8 is outside the housing 9 but is not limited to this structure. For example, the drawer 8 may not be removed from the housing 9 and a portion of the drawer 8 may be exposed from the housing 9.

What is claimed is:

1. An image forming apparatus comprising:

a housing;

a drawer movable between a housed position at which the drawer is housed in the housing, and a shifted position at which the drawer is shifted from the housed position toward an exterior of the housing;

a photosensitive member rotatably supported by the drawer;

a first roller rotatably supported by the drawer;

a second roller rotatably supported by the housing, disposed to face the first roller, and movable relative to the first roller, the second roller and the first roller being configured to pinch a sheet therebetween and transport the sheet toward the photosensitive member;

an urging member disposed at the housing for urging the second roller toward the first roller; and a positioner disposed at the drawer and configured to position the second roller relative to the first roller when the drawer is at the housed position.

2. The image forming apparatus according to claim 1, wherein the drawer includes a first holder rotatably holding a first rotation shaft, the first roller being rotatable integrally with the first rotation shaft, wherein the positioner is a recess of the first holder, the recess being recessed upwardly into the first holder, and wherein, when the drawer is at the housed position, a second rotation shaft is fitted and located in the recess, the second roller being rotatable integrally with the second rotation shaft.

3. The image forming apparatus according to claim 2, wherein the first holder includes a first guide configured to, in response to movement of the drawer from the shifted position toward the housed position, slidably contact, from above, the second rotation shaft before the second rotation shaft is located in the recess, the first guide being located below an upper end of the second rotation shaft located in the recess.

4. The image forming apparatus according to claim 3, wherein the first holder includes a second guide configured to, in response to the movement of the drawer from the shifted position toward the housed position, slidably contact, from above, the second rotation shaft before the first guide slidably contacts the second rotation shaft, the second guide being inclined downwardly toward the first guide.

5. The image forming apparatus according to claim 2, wherein the first roller includes a first gear fixed to the first rotation shaft and rotatable integrally with the first rotation shaft, and wherein the second roller includes a second gear fixed to the second rotation shaft and rotatable integrally with the second rotation shaft, the first gear and the second gear being configured to mesh with each other when the drawer is at the housed position.

6. The image forming apparatus according to claim 2, wherein the positioner includes:

a most recessed portion configured to face an upper end of the second rotation shaft;

a first side end connecting one end of the most recessed portion and the first guide; and a second side end located opposite to the first guide relative to the first side end and connected to the other end of the most recessed portion to face the first side end, the second side end extending downwardly beyond the first side end.

7. The image forming apparatus according to claim 1, wherein the housing includes a second holder supported movably relative to the housing, the second holder rotatably supporting a second rotation shaft, the second roller being rotatable integrally with the second rotation shaft, wherein the second roller includes a particular gear fixed to the second rotation shaft, and wherein the second holder includes another gear rotatably supported by the second holder, the other gear being configured to mesh with the particular gear to transmit a drive force to the second rotation shaft.

8. The image forming apparatus according to claim 7, further comprising a coupler connected to the other gear.

9. The image forming apparatus according to claim 7, wherein the second holder is movable linearly along a nip line which passes through a first axis of the first roller and a second axis of the second roller when the drawer is at the housed position, and the second holder is pivotable about a pivot axis located opposite to the first roller relative to the second roller.

10. The image forming apparatus according to claim 9, wherein the second holder has a slot extending along the nip line, and wherein the housing includes a cylindrical shaft located in the slot, an axis of the cylindrical shaft serving as the pivot axis of the second holder, and the nip line passing through the pivot axis.

11. The image forming apparatus according to claim 7, wherein the housing includes a covering member covering an end of the second rotation shaft, the second roller being rotatable integrally with the second rotation shaft, wherein the drawer includes a first holder rotatably holding a first rotation shaft, the first roller being rotatable integrally with the first rotation shaft, wherein the positioner is a recess of the first holder, the recess being recessed upwardly into the first holder, and wherein, when the drawer is at the housed position, the covering member covering the end of the second rotation shaft is fitted and located in the recess.

12. The image forming apparatus according to claim 1, further comprising a sheet tray configured to support a sheet, wherein, when the drawer is at the housed position, a transport path having a U-shaped curved portion is defined between the sheet tray and the photosensitive member, and the first roller and the second roller are disposed at an upper end of the U-shaped curved portion.

13. The image forming apparatus according to claim 1, wherein the first roller and the second roller are configured to transport the sheet toward the photosensitive member after aligning a leading edge of the sheet.

* * * * *